US005415397A

United States Patent [19]

Van Holt, Jr.

[11] Patent Number: 5,415,397

[45] Date of Patent: May 16, 1995

[54] GOLF HOLE ACCESSORY

[76] Inventor: Townsend Van Holt, Jr., 1681 Cherokee Rd., Florence, S.C. 29501

[21] Appl. No.: 238,663

[22] Filed: May 5, 1994

[51] Int. Cl.[6] ..... A63B 69/36

[52] U.S. Cl. ..... 273/34 B; 273/178 R

[58] Field of Search ..... 273/180, 34 R, 34 B, 273/181 R, 178 R

[56] References Cited

U.S. PATENT DOCUMENTS

| | | | |
|---|---|---|---|
| 1,329,732 | 2/1920 | Verity . | |
| 1,675,089 | 6/1928 | Bloom . | |
| 2,283,462 | 5/1942 | Richie . | |
| 2,568,279 | 9/1951 | Franz et al. . | |
| 3,643,944 | 2/1972 | Boyes . | |
| 3,843,136 | 10/1974 | Buenzle | 273/180 |
| 3,918,719 | 11/1975 | Welch | 273/34 R |
| 4,149,719 | 4/1979 | Wakefield . | |
| 4,280,698 | 7/1981 | Troiano . | |
| 4,396,194 | 8/1983 | Seiferth . | |
| 4,900,023 | 2/1990 | Gelina | 273/180 |
| 4,906,006 | 3/1990 | Sigunick | 273/34 R |
| 5,028,051 | 7/1991 | Schulz | 273/34 B |
| 5,029,856 | 7/1991 | Bookspan . | |
| 5,040,799 | 8/1991 | Manzione . | |
| 5,078,394 | 1/1992 | Kretz . | |
| 5,180,162 | 1/1993 | Browne . | |

*Primary Examiner*—Mark S. Graham
*Attorney, Agent, or Firm*—Terrance L. Siemens

[57] ABSTRACT

A device for reducing the diameter and increasing the visibility of a conventional golf hole is disclosed. The unit is generally circular, with an outer diameter being the same as that of a regulation golf hole: four and one quarter inches. Depending downwardly and tapering inwards from the periphery of the device is a tapered flange to allow it to be inserted into the hole without distorting or otherwise damaging the hole. The central aperture or opening measures two and one half inches across, thus being of sufficient size to allow a golf ball to pass therethrough, and also providing for a flat annular surface thereabout, for the placement of indicia or the like. The unit is preferably manufactured from a brightly colored plastic, thus increasing the visibility of the hole. Diametrically opposed bulges in the outer periphery provide a snug fit in oversize golf holes.

3 Claims, 2 Drawing Sheets

GOLF HOLE ACCESSORY

BACKGROUND OF THE INVENTION

1. Field of the Invention

The present invention relates to the game of golf. More specifically, it relates to an accessory that can be placed within the cup of a golf hole. Even more specifically, it relates to a golf hole accessory that includes an outer, downwardly directed flange that is tapered to prevent damage to the golf hole when the device is inserted therein. Additionally, small protrusions are spaced around the outside tapered edge of the accessory to allow snug fitting into pre-cut golf holes which are slightly oversized.

2. Description of the Prior Art

In the desire to improve people's scores in the game of golf, an innumerable number of devices have been developed. One of the more challenging portions of the game occurs when the ball is on the putting green and the player is attempting to strike it so that it rolls into the hole. The present invention is directed at improving the skills of the user in this capacity; in that the device, when placed within the hole, decreases its target diameter, while at the same time increases the visibility of the target area. It is presumed that, after practicing with reduced diameter holes fitted with this device, the negotiation of standard diameter hole in actual play will appear an easy matter to the golfer. There are a number of patents issued that relate to putting greens, and the cups placed therein.

First in this discussion is U.S. Pat. No. 1,329,732 issued on Feb. 3, 1920 to George M. Verity wherein there is disclosed an improvement in the flagstaff socket of the putting green cup. The patent has no way of reducing the effective diameter of the golf hole and no structure to facilitate snugly fitting the cup into an oversize hole. By contrast, the instant invention reduces the effective diameter of a practice golf hole and provides means for snugly fitting the device into an oversize hole.

In U.S. Pat. No. 1,675,089 issued on Jun. 26, 1928 to Edgar J. Bloom there is disclosed a golf green cup wherein another improvement in the support of the flag or signal staff is disclosed. The patent has no way of reducing the effective diameter of the golf hole and no structure to facilitate snugly fitting the cup into an oversize hole. By contrast, the instant invention reduces the effective diameter of a practice golf hole and provides means for snugly fitting the device into an oversize hole.

U.S. Pat. No. 2,283,462 issued on May 19, 1942 to James K. Richie there is disclosed a golf ring cup. Unlike applicant's present invention, the tapered, downwardly extending flange is not seen or taught. It is also indicated in the patent that the device is to be placed on a floor or carpet for use, instead of being placed in the actual cup on a putting green. The patent has no way of reducing the effective diameter of an existing golf hole and no structure to facilitate snugly fitting the cup into an existing oversize hole. By contrast, the instant invention reduces the effective diameter of an existing golf hole and provides means for snugly fitting the device into an oversize hole.

U.S. Pat. No. 2,568,279 issued on Sep. 18, 1951 to Arvel O. Franz et al. is of interest in that it discloses a luminescent target, in particular for trap or "skeet" shooting. Other than for its teaching of luminescent material for a disc-shaped object the patent is unrelated to the present disclosure.

In U.S. Pat. No. 3,643,944 issued on Feb. 22, 1972 to Bill A. Boyes there is disclosed a golf cup retaining holder. This includes a cylindrical section and a flat flange section with an aperture that is to be aligned with a golf hole. The device is intended to provide a flanged cup support fitting underneath surrounding artificial-turf green covering. The patent has no way of reducing the effective diameter of an existing golf hole and no structure to facilitate snugly fitting the cup into an existing oversize hole. Unlike the instant invention, there is no teaching of a tapered flange. By contrast, the instant invention reduces the effective diameter of an existing golf hole and provides means for snugly fitting the device into an oversize hole.

In U.S. Pat. No. 4,149,719 issued on Apr. 17, 1979 to William W. Wakefield there is disclosed a cup for a green, specifically a cylindrical cup having therein a cluster of substantially upright smaller pipe members, one of which is dimensioned to support a staff. The patent is not directed to the game of golf and the hole is not a standard sized golf hole. In any event, there is no means shown to reduce the effective diameter of the hole for practice purposes as in the instant invention.

Another patent of interest is U.S. Pat. No. 4,280,698 issued on Jul. 28, 1981 to Joseph Troiano. Disclosed therein is a golf cup cover and putting aid wherein when the device is placed on or over a golf hole, the opening provided is just large enough to permit the entry of a golf ball. The patented device has a plurality of teeth extending downwardly about the periphery and, at the end of each of the teeth, there is an inwardly bent terminal tip to assist in the guiding the device into the golf hole. In addition, the patented device has an upper surface for reducing the effective diameter of the hole which is camouflaged by artificial grass. By contrast, the instant invention is guided into an existing hole by a simple tapered exterior face and the upper face is colored and easily visible so as to provide both a visual aid and an advertising media.

In U.S. Pat. No. 4,396,194 issued on Aug. 2, 1983 to Oscar E. Seiferth there is disclosed a golf practice putting cup wherein a base disk and an inner disk arranged such that a plurality of leaves cut out from the base disk are angled upwards to allow a golf ball to enter, but not to leave, the cup. The patented device is intended to provide a simulated hole and not intended to fit into an existing hole, let alone reduce the effective diameter of an existing hole. By contrast, the instant invention reduces the effective diameter of an existing golf hole and provides means for snugly fitting the device into an oversize hole.

In U.S. Pat. No. 5,029,856 issued on Jul. 9, 1991 there is disclosed a golf cup for artificial greens that has a cylindrical layer of a compressible substance disposed about the upper portion of the inner wall of the cup to simulate the play of a bent grass green. The patent has no way of reducing the effective diameter of an existing golf hole and no structure to facilitate snugly fitting the cup into an existing oversize hole. By contrast, the instant invention reduces the effective diameter of an existing golf hole and provides means for snugly fitting the device into an oversize hole.

Next in this discussion is U.S. Pat. No. 5,040,799 issued to Peter Manzione on Aug. 20, 1991. This is a golf cup putting aid wherein a thin-walled flexible disk simulates a golf hole, and has contained thereon some indicia to stimulate hand-eye coordination while practicing. The patented device is intended to provide a simulated hole and not intended to fit into an existing hole, let alone reduce the effective diameter of an existing hole. By contrast, the instant invention reduces the effective diameter of an existing golf hole and provides means for snugly fitting the device into an oversize hole.

Penultimately, U.S. Pat. No. 5,078,394 issued to Paul O. Kretz on Jan. 7, 1992, discloses a golf putting improvement device wherein when the device is placed within a conventional golf cup it reduces the diameter thereof. In this disclosure it is seen that there is a rim lip about the upper periphery of the retaining portion of the device which extends outwards and that the upper surface of the hole diameter reducing portion is camouflaged with artificial grass. By contrast, the instant invention has a simple tapered exterior fitting into an existing hole without disturbing the surrounding terrain. By further contrast, the upper face of my invention is colored and easily visible so as to provide both a visual aid and an advertising media.

And lastly, U.S. Pat. No. 5,180,162 issued to Richard P. Browne on Jan. 19, 1993, discloses a golf hole collar that fits into an existing golf hole and increases the visibility thereof while also aiding in preventing the hole from drying out, thus degrading the lip. The patent has no way of reducing the effective diameter of an existing golf hole and no structure to facilitate snugly fitting the cup into an existing oversize hole. By contrast, the instant invention reduces the effective diameter of an existing golf hole and provides means for snugly fitting the device into an oversize hole.

None of the above inventions and patents, taken either singly or in combination, is seen to describe the instant invention as claimed.

SUMMARY OF THE INVENTION

The present invention is a device for reducing the diameter and increasing the visibility of a conventional golf hole. The unit is generally circular, with an outer diameter being the same as that of a regulation golf hole (four and one quarter inches). Depending downwardly and tapering inward from the periphery of the device is a tapered flange to allow the device to be inserted into an existing golf hole, which has been cut with a standard hole cutter, without distorting or otherwise damaging the hole. The central aperture or opening measures two and one half inches across, thus being of sufficient size to allow a golf ball to pass therethrough, and also providing for a flat annular surface thereabout, for the placement of brightly colored visual aids, advertising indicia, or the like. The unit is preferably manufactured from a white plastic with a brightly colored area containing imprinted indicia, thus increasing the visibility of the hole. Visibility from afar is also enhanced by the presence of a downwardly extending inner rim whose white color contrasts with the green and brown of the natural grass and turf of the upper surface of an existing golf hole.

Accordingly, it is a principal object of the invention to provide a golf hole accessory which overcomes the disadvantages of the prior art in a simple but effective manner.

It is a major object of the invention to provide a golf hole accessory wherein the effective size of the hole is diminished to hone the putting skill of the person practicing or playing the game.

It is another object of the invention to provide a golf hole accessory where the flat annular surface surrounding the central bore is brightly colored to increase visibility and where it can also carry indicia, if desired.

It is another object of the invention to provide a golf hole accessory where the central bore includes a downwardly extending flange which is brightly colored to increase visibility and which will serve to provide an accurate simulation of the ball roll achieved with a sharply cut golf hole.

It is a further object of the invention to provide a golf hole accessory wherein downwardly depending flanges extending from the outer periphery of the unit are tapered inwardly, towards the center of the hole, to allow for a simple insertion and levelling process, and lessening the possibility of accidental distortion or damage to the lip of the hole.

It is a further object of the invention to provide a golf hole accessory wherein the inwardly tapered external flanges contain several small diametrically opposed bulges so as to allow the device to firmly fit into an existing golf hole which is slightly oversize at it upper portion.

It is a major goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
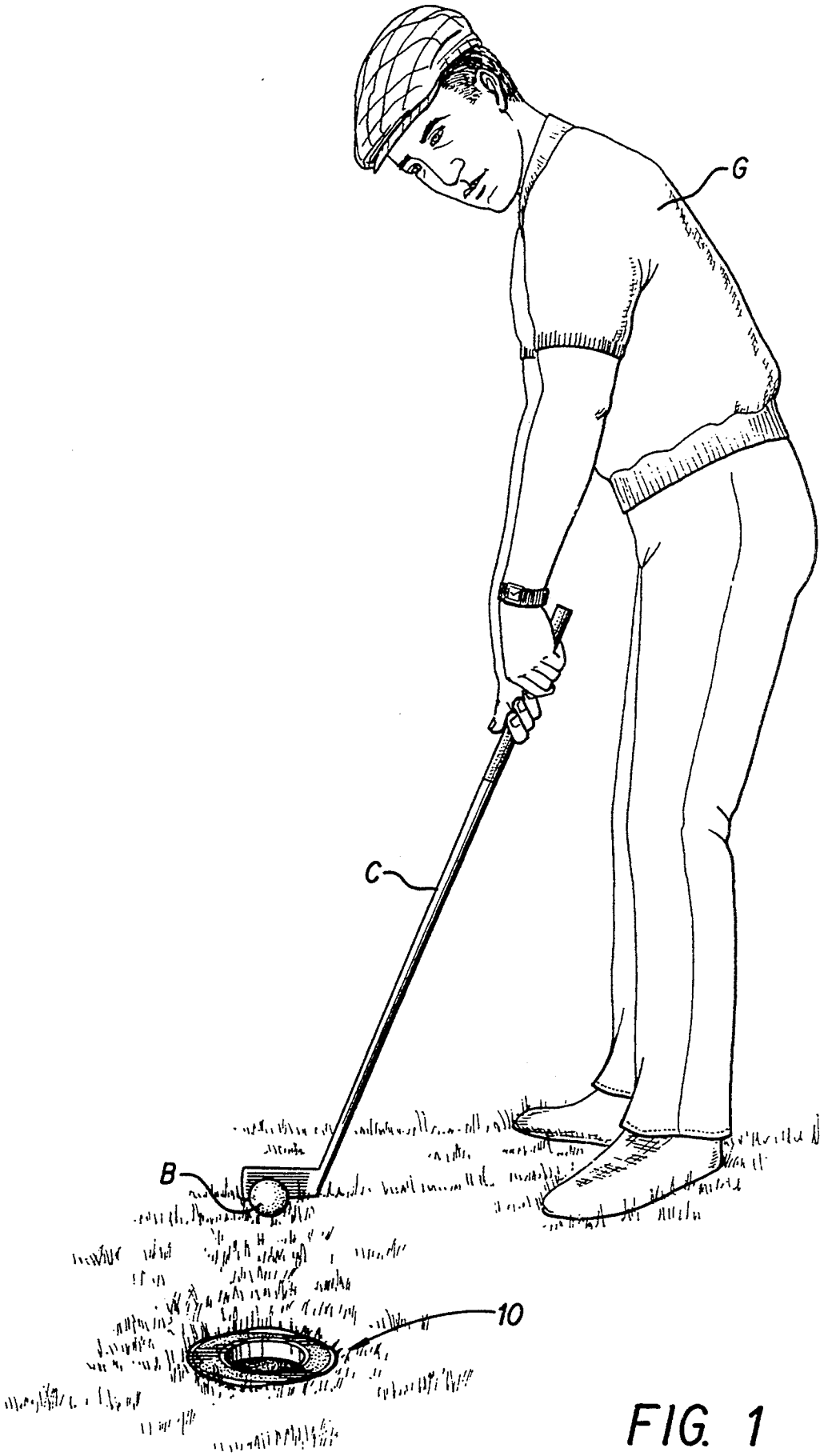
FIG. 1 is an environmental perspective view of the device placed in a golf hole and being used by a golfer.

The present invention is indicated generally, in FIGS. 1 through 4 by numeral 10. As seen in FIG. 1, the device 10 is placed within a standard golf hole being located on a golf green. Golfer G is shown about to strike ball B with club C in order to attempt to roll the ball into the hole. With the device 10 thus in place, the diameter of the hole is reduced from the regulation $4\frac{1}{4}$ inches to $2\frac{1}{2}$ inches. It should be noted that the amount that the diameter is reduced is not limited to this amount, but could be less or more as desired. Device 10 could be made of a variety of materials, but it is contemplated that injection molded plastic would be the most economic form of manufacture, and hence the most desirable. It is additionally contemplated that the device 10 would be manufactured from a white molded plastic with a brightly colored material upper surface, to enhance the visibility of the golf hole target area.

Figure 2:
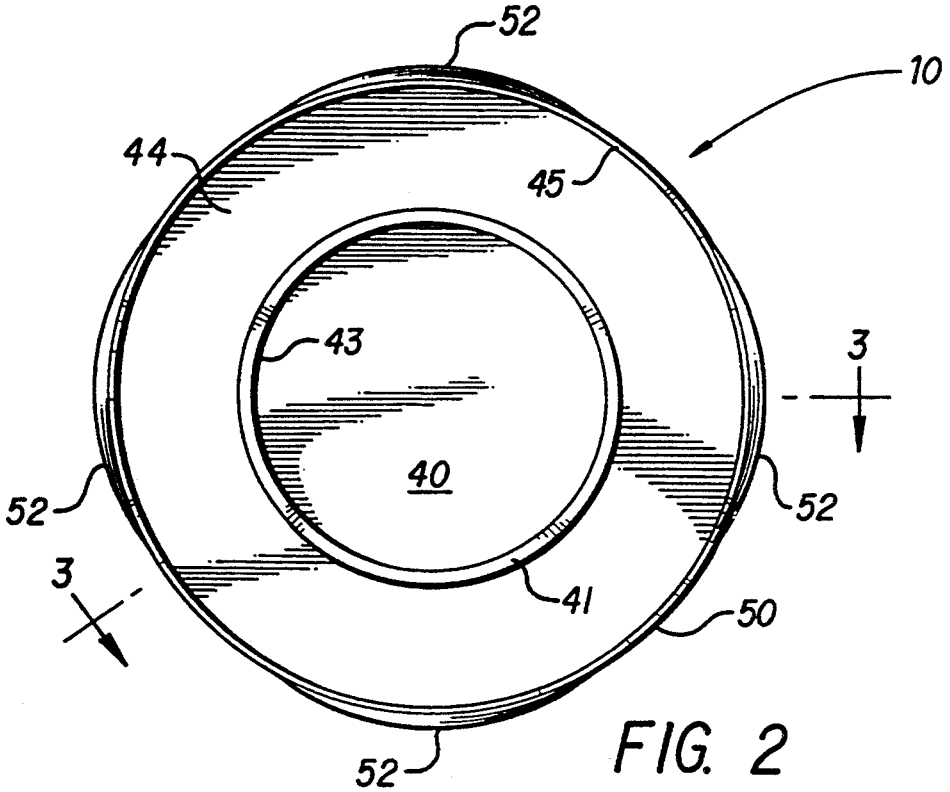
FIG. 2 is a top view of the device, showing the bulges about the outer periphery of the unit to an exaggerated scale for clarity.
Figure 3:
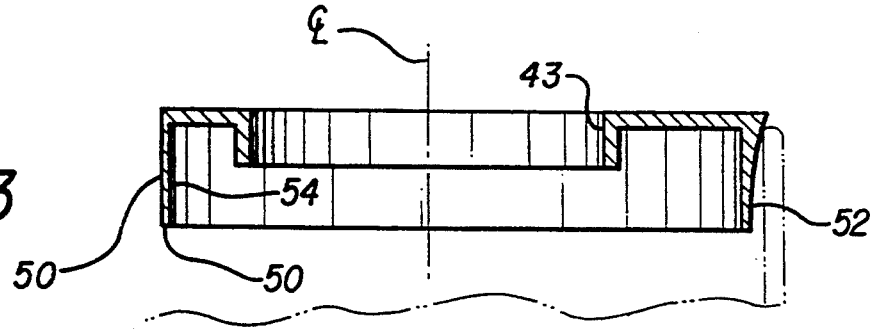
FIG. 3 is a cross section view taken along line 3—3 of FIG. 2.
Figure 4:
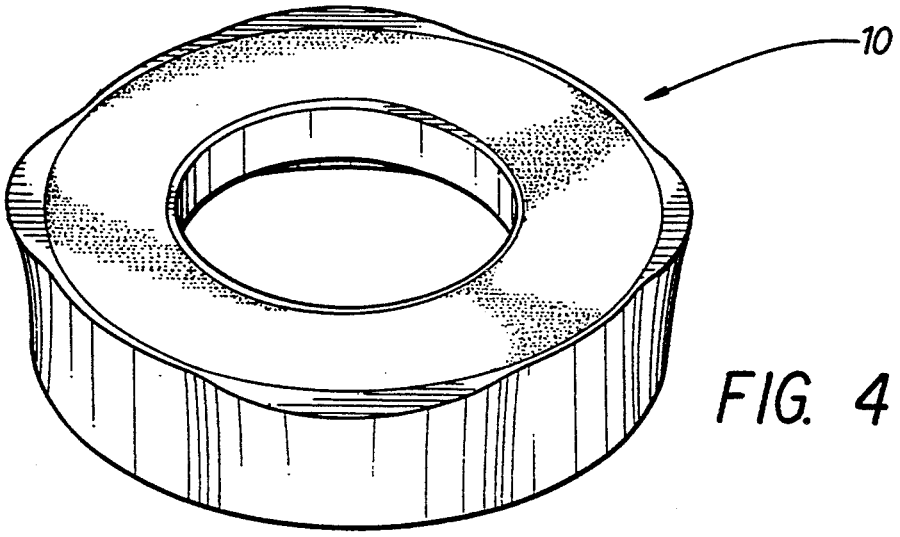
FIG. 4 is a perspective view of the device looking downward on the top face.

Turning to FIGS. 2 and 3, more specific details concerning the structure of the accessory 10 will be discussed. The device 10 has an outer periphery 50 and a central aperture 40, both seen in FIG. 2. The central aperture 40 has a downturned inner edge 43 best seen in FIG. 3. The purpose of this downturned inner edge is to provide an accurate roll to the golf ball and also to improve the visibility of the device from afar. Between this edge 43 and the outer periphery 50 of the device 10 there is defined a flat brightly colored annular surface 44. This surface can carry advertising indicia it could be unmarked. It is contemplated that the device could be so inexpensive to manufacture as to be used as a corporate giveaway item at affairs such as golf tournaments and thus afford the corporation an inexpensive display means for the corporate logo. As noted above, it is contemplated that this area, being the primary portion of the device 10 that is visible when in use, would be brightly colored to increase the visibility of the target area. Another contemplated aspect of the invention is that it could be manufactured of, or be all or partly coated by, a luminescent material. Thus the novelty of the device would be enhanced by allowing the user to practice or play a putting game in low light conditions, or even in darkness. Turning now to FIG. 3, there is seen the depending flange 50. This flange 50 extends downwardly from the outer periphery 30 and is continuous therewith. The flange 50 has a series of diametrically opposed bulges 52 of slightly greater diameter than the diameter of flange 50. The center line in FIG. 3 indicates an axis collinear with that of the center of the golf hole 20. Flange 50 tapers slightly and smoothly inward towards the center line, and thus towards the center of the hole. Bulges 52 taper more radically in the same direction. It should be pointed out that the actual thickness of bulges 52 has been exaggerated in the drawings for clarity and that the real thickness is somewhat less than one sixteenth of an inch. These bulges allow the device 10 to be placed in a golf hole 20 and be leveled so that the annular surface 44 presents impediment to a ball entering the central aperture 40 and, thus, the hole 20. Additionally, these tapered bulges allow the device 10 to be placed within the hole 20 much in the same manner as a cork is placed in a bottle; with smooth downward pressure. The construction of the flanges 50 and 52 in relation to the periphery of the hole as thus described is seen to prevent the inadvertent deforming or damaging of the lip of the hole 20. The slightly greater outside diameter across the bulges 52 is effective to prevent the device from dropping too far into holes that are slightly oversize while at the same time not appreciably deforming correctly sized holes.

The device as thus described could also be used to "round out" or smooth a lip that had been damaged by gently urging the deformed lip back into the proper shape and diameter. Thus the device is not only useful as a practice aid on the putting green but is also useful as a repair device for damaged holes which may be found on the regular course golf greens.

It is to be understood that the present invention is not limited to the sole embodiment described above, but encompasses any and all embodiments within the scope of the following claims.

I claim:

1. A golf cup accessory for reducing the effective diameter of an existing golf hole comprising:

a generally circular outer periphery, a central aperture, and a downwardly extending outer flange continuous with said outer periphery, said flange tapering inwardly, towards said central aperture;

a flat upper annular surface, bounded by said outer periphery and said central aperture;

a downwardly extending inner flange surrounding said central aperture, wherein said inner flange is of contrasting color so as to improve the visibility of said central aperture from afar; whereby said accessory may be inserted into a golf hole and leveled therein with the top of the hole, and said tapered flange prevents damage to the lip of the hole during insertion.

2. The accessory according to claim 1, wherein said accessory is made from an injection molded plastic.

3. The accessory according to claim 1, further comprising;

a series of diametrically opposed bulges in said outer periphery of said downwardly extending outer flange, wherein said bulges provide a stable fit of said accessory within the existing golf hole even when the hole is slightly oversized.

* * * * *